United States Patent [19]

Sossin

[11] 4,183,252

[45] Jan. 15, 1980

[54] ANCILLARY VALVE ROCKER MEANS

[76] Inventor: Mark W. Sossin, 85 Oakland Ave., Rockaway, N.J. 07866

[21] Appl. No.: 932,287

[22] Filed: Aug. 9, 1978

[51] Int. Cl.[2] ..... F16H 25/08; F16H 35/08

[52] U.S. Cl. ..... 74/55; 74/838

[58] Field of Search ..... 74/55, 56, 60, 838, 74/568; 30/220

[56] References Cited

U.S. PATENT DOCUMENTS

| | | | |
|---|---|---|---|
| 3,757,749 | 9/1973 | Hatz | 74/55 |
| 3,797,323 | 3/1974 | Brane | 74/55 |
| 4,036,066 | 7/1977 | Hook | 74/55 |

*Primary Examiner*—Patrick D. Lawson

*Attorney, Agent, or Firm*—Thomas N. Neiman

[57] ABSTRACT

According to the depicted embodiment, the novel ancillary valve rocker means comprises an ancillary valve rocker which is mountable atop the standard valve rocker, and which has a longer pivot arm, and first and second rods which communicate movement from the standard valve rocker to one end of the ancillary valve rocker, and translate the movement into a greater translation of the valve rod. The first and second rods, secondary push rods, are more widely spaced apart, whereat they engage the ancillary valve rocker than where they engage the standard valve rocker and valve rod end, and this together with the longer "reach" of the ancillary valve rocker causes the valve rod to move through an exaggerated translation. The inventive rocker means are adjustable, whereby the amount of valve rod movement may be selectively determined.

6 Claims, 4 Drawing Figures

ANCILLARY VALVE ROCKER MEANS

This invention pertains to valve rocker assemblies, and in particular to means for modifying or altering the operation of valve rocker assemblies.

Particularly in automobile engines for sport racing, it is desirable to alter the dwell time during which intake and/or exhaust valves remain open. Now, while many types of modifications might be undertaken to effect such alteration, it is more desirable and less expensive to be able to simply retrofit the standard valve rocker assembly with a modification kit.

It is an object of this invention to set forth a novel means which greatly simplifies valve rocker performance modification.

It is particularly an object of this invention to disclose an ancillary valve rocker means, for use with a standard valve rocker assembly which has a given valve rocker, and a push rod operable therewith for cyclically translating a valve rod, the novel, ancillary valve rocker means comprising an ancillary valve rocker; means for mounting said ancillary valve rocker atop a given valve rocker; first rod means slidably engaged with said mounting means for causing a first end thereof to effect a contacting engagement with a first end of said ancillary rocker, and to cause a second end of said first rod means to effect a contacting engagement thereof with a first end of any underlying, given valve rocker atop of which said ancillary valve rocker means is caused to be mounted; and second rod means slidably engaged with said mounting means for causing a first end of said second rod means to effect a contacting engagement thereof with a second end of said ancillary rocker, and to cause a second end of said second rod means to effect a contacting engagement thereof with an exposed end of any underlying valve rod; wherein said mounting means comprises means supporting said ancillary valve rocker on an axis lying intermediate said first and ends of said ancillary valve rocker, and means disposing said first ends of said first and second rod means a first distance therebetween, and said second ends of said first and second rod means a distance therebetween which is less than said first distance, whereby a movement of such a first end of any given, underlying valve rocker through a given arc is converted into movement of said second end of said ancillary valve rocker through an arc greater than said given arc, to cause said second end of said second rod means to effect an exaggerated translation of any underlying valve rod with which said second rod means is engaged.

Further objects of this invention, as well as the novel features thereof, will become more apparent by reference to the following description, taken in conjunction with the accompanying figures, in which.

Figure 1:
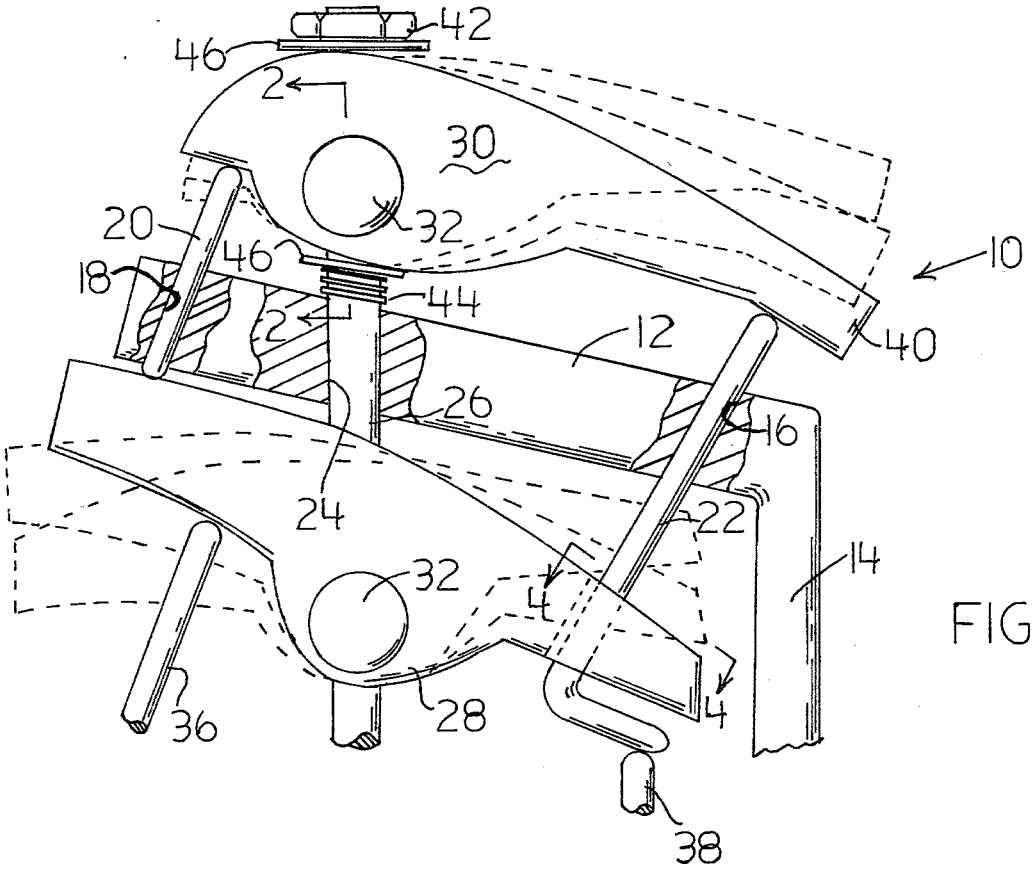
FIG. 1 is a side elevational view, partially cross-sectioned or broken away, depicting an embodiment of the invention in association with a standard or conventional valve rocker assembly.
Figure 2:
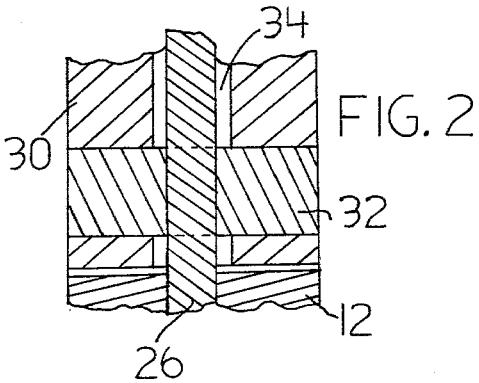
FIG. 2 is a cross-sectional view taken along section 2—2 of FIG. 1.
Figure 3:
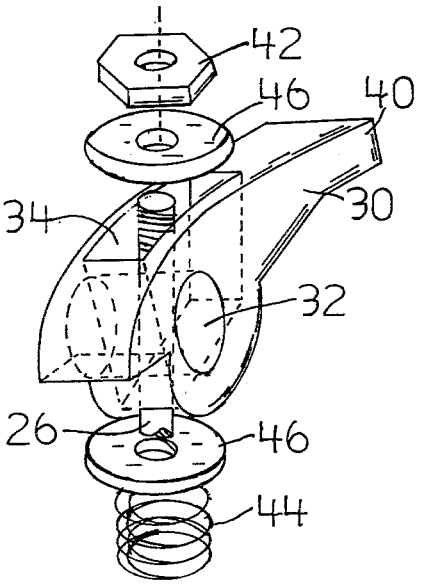
FIG. 3 is a combination isometric and exploded view depicting the novel ancillary valve rocker with the spring-loading thereof and the adjusting nut therefor.

As shown in the figures, the inventive ancillary valve rocker means 10 comprises a mounting plate 12 having a support limb 14 extending therefrom. Limb 14 is provided for fixing the mounting plate 12 to an engine housing or the like. The mounting plate 12 has a pair of rod holes 16 and 18 in which secondary push rods 20 and 22 are slidably received. In addition, the mounting plate 12 has a post hole 24 formed therethrough to receive a mounting post 26.

According to my invention, the original mounting post for the "standard" valve rocker 28 is supplanted with mounting post 26—in order that the ancillary valve rocker 30 may be fixed in place. Alteratively, of course, the original mounting post may accept an extension (on which to fix the ancillary valve rocker).

Mounting post 26 slidably receives a round bearing 32 which traverses and bridges across a void 34 formed in the ancillary valve rocker 30. The void is provided to allow the rocker 30 to slue through the desired arc in response to the forces addressed thereto by the rods 20 and 22.

As the "standard" valve rocker 28 is rocked in a first direction by the "standard" push rod 36, it engages one of the secondary push rods 20. The latter engages a first end of the ancillary valve rocker 30, causing the rocker 30 to move through a wide arc. The opposite end of the rocker 30 engages the second of the secondary push rods 22, and the latter is engaged with the exposed end of the valve rod 38.

It will be evident that, as the second end 40 of the ancillary valve rocker 30 defines a greater "reach" than the corresponding end of the valve rocker 28, end 40 will move through a greater arc. Consequently, for a given movement of the original valve rocker 28, the valve rod 38 will be translated through an exaggerated movement. The secondary push rods 20 and 22 are more widely spaced apart at their uppermost ends in order that the benefit of the greater slue of end 40 can be realized—and transmitted to the valve rod 38.

Figure 4:
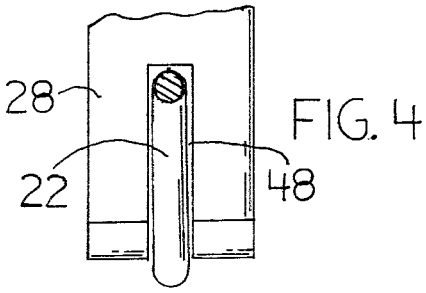
FIG. 4 is a cross-sectional view, taken along section 4—4 of FIG. 1, showing the cooperation of the given, underlying valve rocker and the second of the secondary push rods.

The angulations of the rods 20 and 22, and the length of the ancillary valve rocker 30, the location of its rocking axis, etc., are all matters of designer's choice. That is, the invention is not limited to any give dimensions, spacings, etc. Rather, all such alterations of dimensions, angulations, etc., are considered to be within the ambit of my invention and suggested thereby. In this connection, finite adjustment of the response of the invention may be made by means of the adjusting nut 42 which is fixed to a threaded end of post 26 and which constrains a compression spring 44 and washer 46 therebelow against the lowermost surface of ancillary valve rocker 30. Other adjustment means perhaps will suggest themselves to those skilled in this art, in the light of my disclosure. Too, to accommodate the translation of the working end of rod 22, it is my teaching to slot the outermost end of the right-hand (per FIG. 4) end of the original valve rocker 28. The slot 48 has sufficient length to receive the rod 22 in all of its relative angulations. Alternatively an elongated hole could have been provided. Now, if it desired to omit having to bore or slot the valve rocker 28, an alternative embodiment of my invention can be practiced by employing a rod 22 which has a wide, laterally disposed, U-shaped bend therein—which bend will circumvent the "working" end of the valve rocker 28, and reach in therebelow to engage the end of valve rod 38. Accordingly, while I have described my invention in connection with a specific embodiment thereof, it is to be clearly understood that this is done only by way of example and not as a limitation to the scope of my invention as set forth in the objects thereof and in the appended claims.

I claim:

1. For use with a standard valve rocker assembly which has a given valve rocker, and a push rod operable therewith for cyclically translating a valve rod, ancillary valve rocker means, comprising:

an ancillary valve rocker;

means for mounting said ancillary valve rocker atop a given valve rocker;

first rod means slidably engaged with said mounting means for causing a first end of said first rod means to effect a contacting engagement thereof with a first end of said ancillary rocker, and to cause a second end of said first rod means to effect a contacting engagement thereof with a first end of any underlying, given valve rocker atop of which said ancillary valve rocker means is mounted; and second rod means slidably engaged with said mounting means for causing a first end of said second rod means to effect a contacting engagement thereof with a second end of said ancillary rocker, and to cause a second end of said second rod means to effect a contacting engagement thereof with an exposed end of any underlying valve rod; wherein said mounting means comprises means supporting said ancillary valve rocker rockably on an axis lying intermediate said first and second ends of said ancillary valve rocker, and means disposing said first ends of said first and second rod means a first distance therebetween, and said second ends of said first and second rod means a distance therebetween which is less than said first distance, whereby a movement of such a first end of any given, underlying valve rocker through a given arc is converted into movement of said second end of said ancillary valve rocker through an arc greater than said given arc, to cause said second end of said second rod means to effect an exaggerated translation of any underlying valve rod with which said second rod means is engaged.

2. Ancillary valve rocker means, according to claim 1, wherein:

said mounting means includes a support post which penetrates said ancillary valve rocker perpendicular to said axis.

3. Ancillary valve rocker means, according to claim 2, wherein:

said ancillary valve rocker has a bore formed therethrough, along said axis, and has a round bearing rotatably disposed within said bore; and said bearing has a hole formed therethrough, bisecting said axis, and said support post is slidably engaged with said hole.

4. Ancillary valve rocker means, according to claim 2, wherein:

said post projects outwardly from atop said ancillary valve rocker and is threaded thereat to receive an adjusting nut.

5. Ancillary valve rocker means, according to claim 3, wherein:

said ancillary valve rocker has a void formed therewithin to accommodate rocking movement thereof relative to said support post.

6. Ancillary valve rocker means, according to claim 5, wherein:

said round bearing traverses and bridges across said void;

said post projects outwardly from atop said void, and is threaded thereat to receive an adjusting nut; and further including a compression spring in envelopment of said post, having one end thereof engaging an lowermost surface of said ancillary valve rocker;

a washer surmounting the opposite end of said spring; and an adjusting nut threadedly engaged with said post and constraining said washer and spring.

* * * * *